US009927188B2

(12) United States Patent
Liu et al.

(10) Patent No.: US 9,927,188 B2
(45) Date of Patent: Mar. 27, 2018

(54) METAMATERIALS-ENHANCED PASSIVE RADIATIVE COOLING PANEL

(71) Applicant: Palo Alto Research Center Incorporated, Palo Alto, CA (US)

(72) Inventors: Victor Liu, Mountain View, CA (US); Bernard D. Casse, Saratoga, CA (US); Armin R. Volkel, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 321 days.

(21) Appl. No.: 14/740,009

(22) Filed: Jun. 15, 2015

(65) Prior Publication Data

US 2016/0363396 A1 Dec. 15, 2016

(51) Int. Cl.
*F28F 13/18* (2006.01)
*F28F 3/00* (2006.01)
(Continued)

(52) U.S. Cl.
CPC ..... *F28F 13/18* (2013.01); *F28B 1/06* (2013.01); *F28F 3/00* (2013.01); *F28F 2013/001* (2013.01); *F28F 2245/06* (2013.01)

(58) Field of Classification Search
CPC ..... F28F 13/18; F28F 3/00; F28F 2013/001; F28F 2245/06
(Continued)

(56) References Cited

U.S. PATENT DOCUMENTS 3,929,594 A 12/1975 Fromson
4,065,364 A 12/1977 Fromson
(Continued)

FOREIGN PATENT DOCUMENTS

CN 102778144 11/2012
CN 103312042 A 9/2013
(Continued)

OTHER PUBLICATIONS

Aoyama, Takahiko et al. "Energy response of a full-energy-absorption neutron spectrometer using boron-loaded liquid scintillator BC-523", Nuclear Instruments and Methods in Physics Research A 333 (1993) 492-501, 10 pages.
(Continued)

*Primary Examiner* — Jianying Atkisson
*Assistant Examiner* — Joel Attey
(74) *Attorney, Agent, or Firm* — Bever, Hoffman & Harms, LLP

(57) ABSTRACT

A low-cost passive radiative cooling panel includes an emitter layer disposed under an upper reflective layer, where the emitter layer includes metamaterial nanostructures (e.g., tapered nanopores) configured to dissipate heat in the form of radiant energy that is transmitted through the reflective layer into cold near-space. In an embodiment the emitter layer includes ultra-black material configured to emit, with an emissivity close to unity, radiant energy having wavelengths/frequencies that fall within known atmospheric transparency windows (e.g., 8-13 μm or 16-28 μm). In a practical embodiment the emitter layer is formed using a modified Anodic Aluminum Oxide (AAO) self-assembly technique followed by electroless plating that forms metal-plated tapered nanopores. The reflective layer includes a distributed Bragg reflector configured to reflect at least 94% of incident solar light while passing the emitted radiant energy, and in some embodiments is implemented using a low-cost, commercially available solar mirror film.

6 Claims, 6 Drawing Sheets

(51) Int. Cl.
*F28B 1/06* (2006.01)
*F28F 13/00* (2006.01)

(58) Field of Classification Search
USPC ..... 165/133
See application file for complete search history.

(56) References Cited

U.S. PATENT DOCUMENTS

| | | | | |
|---|---|---|---|---|
| 4,315,873 | A | 2/1982 | Smith et al. | |
| 4,779,000 | A | 10/1988 | Ing | |
| 5,043,739 | A | 8/1991 | Logan et al. | |
| 5,712,166 | A | 1/1998 | Broan | |
| 5,905,263 | A | 5/1999 | Nishizawa | |
| 8,621,245 | B2 | 12/2013 | Shearer et al. | |
| 8,680,945 | B1 | 3/2014 | Wang | |
| 2002/0180639 | A1 | 12/2002 | Rickett | |
| 2004/0207486 | A1 | 10/2004 | York | |
| 2004/0238751 | A1 | 12/2004 | Penn | |
| 2006/0234505 | A1 | 10/2006 | Asano et al. | |
| 2008/0049228 | A1 | 2/2008 | Chan | |
| 2009/0207000 | A1 | 8/2009 | Mickle et al. | |
| 2009/0220802 | A1 | 9/2009 | Faber et al. | |
| 2009/0284351 | A1 | 11/2009 | Rossman et al. | |
| 2011/0303850 | A1 | 12/2011 | Barillon | |
| 2011/0309686 | A1 | 12/2011 | Scherbenski et al. | |
| 2012/0133547 | A1 | 5/2012 | MacDonald et al. | |
| 2012/0314541 | A1 | 12/2012 | Matsuura | |
| 2013/0076570 | A1 | 3/2013 | Lee et al. | |
| 2013/0187830 | A1 | 7/2013 | Warnick et al. | |
| 2014/0131023 | A1* | 5/2014 | Raman | B64G 1/50 165/185 |
| 2014/0355381 | A1 | 12/2014 | Lai et al. | |
| 2015/0214927 | A1 | 7/2015 | Greene et al. | |
| 2015/0236551 | A1 | 8/2015 | Shearer et al. | |
| 2015/0276489 | A1 | 10/2015 | Cumming | |
| 2015/0380973 | A1 | 12/2015 | Scheb | |
| 2016/0145214 | A1 | 5/2016 | Douce | |
| 2016/0181867 | A1 | 6/2016 | Daniel et al. | |
| 2016/0254844 | A1 | 9/2016 | Hull et al. | |
| 2016/0331054 | A1* | 11/2016 | Coza | B32B 27/12 |
| 2016/0336198 | A1 | 11/2016 | Singleton et al. | |
| 2016/0359378 | A1 | 12/2016 | Kuhn et al. | |

FOREIGN PATENT DOCUMENTS

| | | |
|---|---|---|
| WO | 2007015281 | 2/2007 |
| WO | 2013039926 | 3/2013 |
| WO | 2015038203 | 3/2015 |

OTHER PUBLICATIONS

Flaska, Marek et al., "Digital pulse shape analysis for the capture-gated liquid scintillator BC-523A", Nuclear Instruments and Methods in Physics Research A 599 (2009) 221-225, 5 pages.

Vanier, Peter E., et al., "Directional detection of fission-spectrum neutrons", 1-4244-1302-8/07, 2007 IEEE, 5 pages.

Vanier, Peter E., et al., "Calibration and Testing of a Large-Area Fast-Neutron Directional Detector", Brookhaven National Laboratory, BNL-79632-2007-CP, 8 pages.

Mascarenhas, Nicholas, et al., "Directional Neutron Detectors for Use with 14 MeV Neutrons", Sandia Report, SAND2005-6255, printed Oct. 2005, 32 pages.

Mirenda, Martin, et al., "Ionic liquids as solvents for liquid scintillation technology, Cerenkov counting with 1-Butyl-3-Methylimidazolium Chloride", Radiation Physics and Chemistry 98 (2014) 98-102, 5 pages.

Swiderski, L., et al., "Further Study of Boron-10 Loaded Liquid Scintillators for Detection of Fast and Thermal Neutrons", IEEE Transactions on Nuclear Science, vol. 57, No. 1, Feb. 2010, 6 pages.

Pratap et al., "Plasmonic Properties of Gold-Coated Nanoporous Anodic Alumina With Linearly Organized Pores," Pramana—J. Phys. (Dec. 2014), vol. 83, No. 6, pp. 1025-1033.

Noh et al., Highly Self-Assembled Nanotubular Aluminum Oxide by Hard Anodization, (Jan. 29, 2011), J. Mater. Res., vol. 26, Issue 2, pp. 186-193.

Juan Li et al., "Facile Method for Modulating the Profiles and Periods of Self-Ordered Three-Dimensional Alumina Taper-Nanopores," ACS Appl. Mater. Interfaces 2012, 4, 5678-5683.

Juan Li et al., "Tailoring Hexagonally Packed Metal Hollow-Nanocones and Taper-Nanotubes by Template-Induced Preferential Electrodeposition," ACS Appl. Mater. Interfaces 2013, 5, 10376-10380.

* cited by examiner

METAMATERIALS-ENHANCED PASSIVE RADIATIVE COOLING PANEL

FIELD OF THE INVENTION

This invention relates to radiative cooling, and in particular to passive radiative cooling panels.

BACKGROUND OF THE INVENTION

Large cooling systems play an important role in the generation of electricity. Most power plants generate electricity by way of converting a coolant (typically water) into a heated gaseous state (e.g., steam) using a heat source (e.g., a nuclear reactor core, a gas/coal/oil furnace, or a solar concentrator), and then passing the heated gaseous coolant through a generator (i.e., a rotating machine that converts mechanical power into electrical power). Before the coolant exiting the generator can be returned to the heat source, the coolant must be entirely reconverted from its gaseous state to its liquid state, which typically involves dissipating sufficient heat from the coolant to drop the coolant's temperature below its boiling point temperature. Due to the large volumes of coolant used in large power plants, this cooling function is typically performed by piping the coolant leaving the generators to large cooling systems disposed outside the power plant, whereby heat from the coolant is harmlessly dissipated into the surrounding environment. Failure to fully reconvert the coolant to its liquid state before returning to the power plant significantly reduces the power plant's efficiency. Hence, large cooling systems play and important role of in the generation of electricity.

Cooling systems can be categorized into two general classes: wet cooling systems that consume water (i.e., rely on evaporation to achieve the desired cooling power), and dry cooling systems that utilize convection or radiation to remove heat without consuming water. Generally speaking, a dry cooling system based on conventional technology would occupy a significantly larger area and require higher operating costs than a comparable wet cooling system capable of generating the same amount of cooling power. Hence, most large power plants, particularly those in hot and humid climate zones where traditional dry-cooling is impractical, utilize wet cooling systems that collectively consume enormous amounts of water (i.e., tens of billions of gallons of water per day). That is, when water is abundant and cheap, wet cooling systems can be significantly less expensive to build and operation than dry cooling systems based on conventional technology. However, in dry regions or regions experiencing curtailed water supplies (e.g., due to drought), the use of wet cooling systems can become problematic when precious water resources are necessarily diverted from residential or agricultural areas for use in a power plant.

Radiative cooling is a form of dry cooling in which heat dissipation is achieved by way of radiant energy. All objects constantly emit and absorb radiant energy, and undergo radiative cooling when the net energy flow is outward, but experience heat gain when the net energy flow is inward. For example, passive radiative cooling of buildings (i.e., radiative cooling achieved without consuming power, e.g., to turn a cooling fan) typically occurs during the night when long-wave radiation from the clear sky is less than the long-wave infrared radiation emitted from the building's rooftop. Conversely, during the daytime solar radiation directed onto the building's roof is greater than the emitted long-wave infrared radiation, and thus there is a net flow into the sky.

In simplified terms, the cooling power, $P_{cooling}$, of a radiating surface is equal to the radiated power, $P_{rad}$, less the absorbed power from atmospheric thermal radiation from the air. $P_{atm}$, the solar irradiance, $P_{sun}$, and conduction and convection effects, $P_{con}$:

$$P_{cooling}=P_{rad}-P_{atm}-P_{sun}-P_{con} \quad \text{(Equation 1)}$$

In practical settings, $P_{atm}$ is determined by ambient temperature, $P_{sun}$ varies in accordance with time of day, cloud cover, etc., and is zero at nighttime, and $P_{con}$ is determined by structural details of the cooler. From Equation 1, maximizing $P_{cooling}$ during daytime entails increasing $P_{rad}$ by increasing the emissivity of the surface, minimizing the effect of $P_{sun}$ (e.g., by making use of a broadband reflector), and mitigating convection and conduction effects $P_{con}$ by way of protecting the cooler from convective heat sources. Assuming a combined non-radiative heat coefficient of 6.9 $W/m^2K$, Eq. 1 thus yields a practical minimum target $P_{rad}$ value of 55 $W/m^2$ during daytime, and 100 $W/m^2$ during nighttime, which translates into a drop in temperature around 5° C. below ambient.

An ideal high-performance passive radiative cooler can thus be defined as a passive radiative cooling device that satisfies the following three conditions. First, it reflects at least 94% of solar light (mostly at visible and near-infrared wavelengths) to prevent the cooling panel from heating up, hence minimizing $P_{sun}$. Second, it exhibits an emissivity close to unity at the atmospheric transparency windows (e.g. 8-13 μm (dominant window), 16-25 μm, etc.) and zero emission outside these windows. This ensures that the panel doesn't strongly emit at wavelengths where the atmosphere is opaque, hence minimizing $P_{atm}$. Third, the device is sealed from its environment to minimize convection that would otherwise contribute to an additional heat load, hence minimizing $P_{conv}$. Convection on top of the device is a detriment in this case since it operates below ambient temperature. In short, an ideal high-performance passive radiative cooler is an engineered structure capable of "self-cooling" below ambient temperatures, even when exposed to direct sunlight, and requires no power input or material phase change to achieve its cooling power.

Currently there are no commercially available passive radiative cooling technologies that meet the three conditions defining an ideal high-performance passive radiative cooler. Existing radiative cooling foils can be inexpensive, but are currently limited to operating in the absence of sunlight (i.e., mostly at nighttime). Current state of the art attempts to achieve daytime passive radiative cooling utilize emitter-over-reflector architectures that require complex spectrally-selective emitter materials that are too expensive to provide commercially viable alternatives to traditional powered cooling approaches. Moreover, there are no (i.e., zero) passive radiative cooling technologies, commercial or otherwise, that are easily scalable to provide dry cooling for large power plants disposed in hot or humid regions. That is, the challenge for dry cooling of power plants is to design photonic structures that can be easily fabricated and scaled up to very large areas (e.g. 1 $km^2$) at low cost.

What is needed is a low-cost passive (i.e., requiring no power/electricity input) radiative cooling device that achieves high-performance passive radiative cooling while avoiding the high-cost and complexity associated with conventional attempts.

SUMMARY OF THE INVENTION

The present invention is directed to a low-cost passive radiative cooling panel and associate cooling method in which a (lower) emitter layer is disposed under an (upper) reflective layer, where the emitter layer includes metamaterial nanostructures (i.e., subwavelength engineered structures with tailored optical properties) that are configured to dissipate heat in the form of emitted radiant energy that is then transmitted through the reflective layer into cold near-space. In one embodiment, the reflective layer is configured to reflect at least 94% of incident solar light (i.e., solar radiation having a frequencies of 2 μm or less). Because the reflective layer is disposed over the emitter layer, the emitter layer is shielded (shaded) from sunlight by the reflective layer during daylight hours, thus meeting the first condition defining an ideal high-performance passive radiative cooling device. In another embodiment, the emitter layer is configured to emit, with an emissivity close to unity, radiant energy having wavelengths/frequencies that fall within one or more atmospheric transparency windows (i.e., the emitted "ATW radiant energy" has wavelengths in the range of 8 μm to 13 μm, and/or in the range of 16-28 μm, which are two known atmospheric transparency windows), thus substantially satisfying the second condition of an ideal high-performance passive radiative cooling device. Although the emitter-under-reflector arrangement does not necessarily facilitate mitigate, convection is not a significant factor in most dry cooling applications (e.g., cooling power plant effluent remains above ambient temperature, so convection does not affect the system), whereby the third condition of an ideal-performance cooler becomes insignificant. Accordingly, the present invention facilitates the production of passive radiative cooling panels that substantially satisfy the three conditions defining an ideal high-performance passive radiative cooling device. Preliminary experimental results, based on estimates of net cooling power derived by solving the heat balance formula in Equation 1 (above) indicate low-cost passive radiative cooling panels formed in accordance with the present invention provide net cooling powers approaching 75 $W/m^2$ and 130 $W/m^2$ during daytime and nighttime, respectively, and an early-stage prototype exhibited cooling of an aluminum substrate by 6° C. below ambient temperature in broad daylight, which is believe is a record performance for daytime radiative cooling. Moreover, unlike conventional spectrally-selective emitter approaches that require complex and expensive spectrally-selective emitter-over-reflector architectures, the reflector-over-emitter arrangement of the present invention facilitates low-cost, scalable passive radiative cooling by way of facilitating the use of established low-cost production methods and, in some cases, existing low-cost materials.

According to an embodiment of the present invention, the emitter layer includes metamaterial nanostructures (i.e., subwavelength engineered structures with tailored optical properties) disposed in an ultra-black metamaterial-based pattern on a base material and configured such that the resulting ultra-black material converts thermal energy into radiant energy. In some embodiments, suitable ultra-black materials include any of several metamaterial nanostructure types including nanopores, or other needle-like, dendritic or porous textured surfaces, carbon nanotube forests, or other black films (e.g. black chrome, black silicon, black copper, nickel phosphorus (NiP) alloys). Implementing the broadband emitter layer using ultra-black materials facilitates low-cost production of the passive radiative cooling panels because typically ultra-black emitters are currently available and easier to fabricate (single-layer structures) compared to spectrally-selective emitters (multi-layer structure. Accordingly, the inventors believe several different ultra-black material types may be optimized to generate ATW radiant energy (e.g., radiant energy having wavelengths in the range of 8 μm to 13 μm, and/or in the range of 16-28 μm) with an emissivity close to unity.

According to alternative embodiments of the present invention, passive radiative cooling panels are configured such that substantially all radiant energy emitted from the passive radiative cooling panel has wavelengths corresponding to one or more atmospheric transparency windows (e.g., 8 μm to 13 μm and/or 16 μm to 28 μm). That is, according to the second condition of an ideal-performance cooler, the panel should emit zero radiation outside of the ATW windows in order to minimize performance reduction due to atmospheric thermal radiation. Although passive radiative cooling panels formed in accordance with the present invention may emit, in addition to the ATW radiant energy portion, a small amount of non-ATW radiant energy (i.e., radiant energy having frequencies outside of the ATW windows), in the preferred embodiment substantially all non-ATW radiant energy is precluded. The emitter-under-reflector arrangement of the present invention facilitates two alternative approaches for achieving zero non-ATW emissions: in one approach the reflector layer is configured (or an additional filter layer is added) to block any non-ATW radiant energy generated by the emitter layer, and in the second approach the emitter layer is configured to only generate ATW radiant energy. Each of these approaches requires one of the emitter/reflective layers to exhibit very specific optical properties, which typically means higher production costs. For example, in one embodiment, a low-cost ultra-black material may be utilized that emits broadband radiant energy (i.e., having frequencies both within and outside the atmospheric transparency windows), which requires the use of an upper reflective layer that selectively transmits only ATW portions of the broadband radiant energy (e.g., portions of the broadband radiant energy having wavelengths in the range of 8-13 μm and/or in the range of 16-28 μm), and blocks all non-ATW radiant energy (e.g., having wavelengths below 7 μm, in the range of 14 μm to 15 μm, or above 17 μm). A benefit of this embodiment is that it facilitates the use of a wider range of ultra-black materials, but may require a customized reflector material capable of selectively transmitting only ATW frequencies, or the addition of an infrared filter layer (which could be commercially purchased or designed in the form of a two-dimensional grating structure) that will suppress the problematic bands. In a second embodiment, the ultra-black material is configured to only emit radiant energy having frequencies that are within one or more the atmospheric transparency windows. A benefit of the second embodiment is that it reduces the selective transmission requirements of the upper (reflective) layer, which facilitates implementing the upper layer using certain commercially available solar reflective films, thus reducing total manufacturing costs. However, this approach also requires generating ultra-black materials having the features and tolerances discussed below. In either case, the upper layer functions to reflect incident solar radiation (e.g., radiant energy having wavelengths below approximately 2 μm), and to transmit radiant energy emitted from the ultra-black material having atmospheric transparency window frequencies.

According to a presently preferred embodiment, each passive radiative cooling panel includes an emitter layer comprising an array of tapered nanopores defined into a base material, where each tapered nanopore is a pit-like cavity having an open upper end defined through the top emitter surface, a closed lower end disposed inside the base material, and a substantially conical-shaped side wall extending between the open upper end and the closed lower end. In one embodiment, the open upper end has a larger diameter than the closed lower end such that a diameter of the conic side wall decreases inside each tapered nanopore. In an alternative embodiment, the open upper end is smaller than the closed lower end such that a diameter of the conic wall gradually increases inside each tapered nanopore. The use of tapered nanopores having a suitable size (e.g., having a nominal width in the range of 100 nm to 1 μm) facilitates the production of superior ultra-black materials capable of emitting ATW radiant energy with high emissivity because the tapered structures effectively have smoothly varying refractive indices (grated index medium) that prevent Fresnel reflections.

In accordance with specific embodiments, the emitter layer of each passive radiative cooling panel includes both a base (first) metal material and a plated (second) metal layer that is disposed on the top surface of the first metal (base metal layer) such that a portion of the plated metal layer is disposed inside each of the tapered nanopores. In addition to impedance matching, such metal-coated tapered nanopores will also scatter light inside the ultra-black material, which significantly contributes to the emission of ATW radiant energy. In addition, the large imaginary part of the refractive index of the metal contributes to the attenuation of the light inside the material, producing low reflectance that will physically result in an extremely dark appearance of the surface. In an exemplary embodiment, the base metal layer is implemented using aluminum, and the plated (second) metal layer comprises one or more of nickel (Ni) copper (Cu) and gold (Ag).

According to a practical embodiment of the present invention, the emitter layer of each passive radiative cooling panel is fabricated using a modified Anodic Aluminum Oxide (AAO) self-assembly template technique in which an aluminum layer is anodized in acid to form a porous alumina (aluminum oxide) layer thereon such that the alumina layer includes self-formed, hexagonally packed arrays of nanopores. By gradually changing the process parameters during anodization, tapered nanopores are thus fabricated entirely by forming the alumina that include characteristic tapered side walls. The pitch and diameter (width) of each tapered nanopore formed by this method are dependent on the anodization voltages and process conditions, while the height of each nanopore is controlled by the anodization time. This AAO method is a high-throughput, bottom-up, and low-cost fabrication method to fabricate subwavelength (e.g., sub-50 nm) and very high-aspect ratio (1:1000) tapered nanopores. Because passive radiative cooling inherently requires a large area (i.e., square kilometers) of panels when it comes to practical applications, such as power plant dry cooling, a main techno-economic challenge for developing a passive radiative cooling panel rests on the ability to cost-effectively mass-produce the panels. By forming tapered nanopores using the AAO self-assembly template technique, and then electroless plating a second metal (e.g., Ni, Cu or Ag) onto the alumina, superior metal-coated tapered nanopores are produced with high efficiency, and in a manner that facilitates low-cost mass production of the passive radiative cooling panels using cost-effective roll-to-roll mass-production manufacturing techniques.

According to another embodiment of the present invention, the upper reflective layer of each passive radiative cooling panel comprises a distributed Bragg reflector including multiple sublayers collectively configured to reflect (i.e., exhibit a reflectance of 0.8 or greater) incident solar radiation having wavelengths in the range of 0 to 2 μm, and to transmit/pass therethrough (i.e., exhibit a reflectance of 0.2 or lower) ATW radiant energy, for example, having wavelengths in the range of 8 μm to 13 μm. In some embodiments, commercially available solar mirror films currently used in concentrating solar power (CSP) collectors (e.g., solar films produced by 3M Corporation of St. Paul, Minn. USA, or by ReflecTech, Inc. of Arvada, Colo. USA) exhibit spectral characteristics that are close enough to the desired spectrum, and may be cost-effectively secured to the top surface of the emitter layer, e.g., by way of an optional intervening adhesive layer. In other embodiments that require a reflective layer that selectively transmits only ATW portions of the broadband radiant energy, custom engineered reflective layers may be required.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in passive reflective cooling. The following description is presented to enable one of ordinary skill in the art to make and use the invention as provided in the context of a particular application and its requirements. As used herein, directional terms such as "upper", "upward-facing", "lower", "downward-facing", "top", and "bottom", are intended to provide relative positions for purposes of description, and are not necessarily intended to designate an absolute frame of reference. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
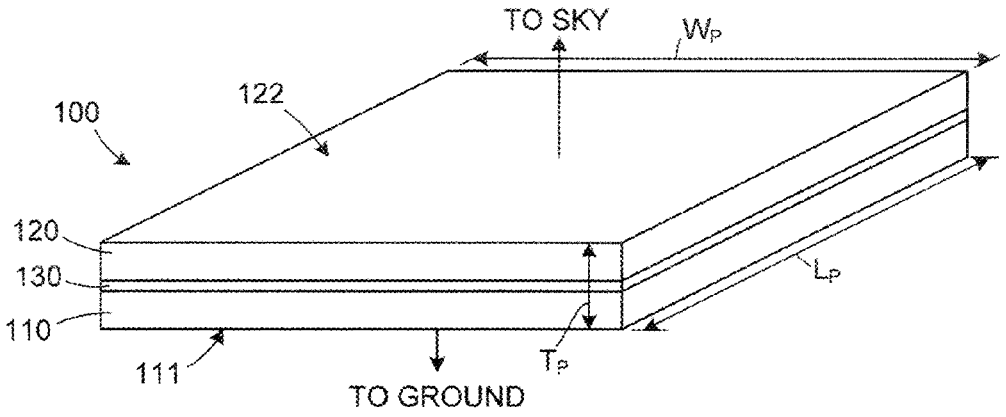
FIG. 1 is a top side perspective view showing an exemplary passive radiative cooling panel according to an embodiment of the present invention.
Figure 2:
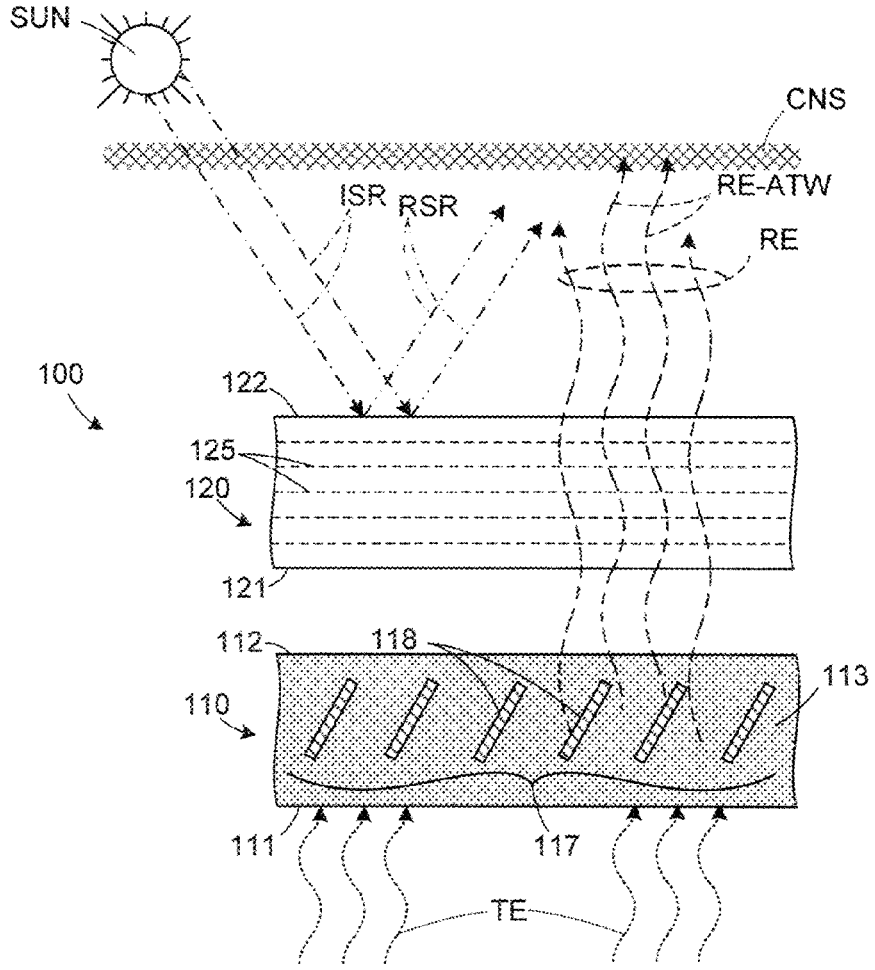
FIG. 2 is a cross-sectional side view showing the passive radiative cooling panel of FIG. 1 in additional detail.

FIG. 1 is a perspective view showing an exemplary passive radiative cooling panel 100 according to a generalized embodiment of the present invention, and FIG. 2 is a partial exploded cross-sectional side view showing panel 100 in additional detail.

Referring to FIG. 1, panel 100 is a laminated structure including at least two layers: an emitter (lower) layer 110 configured to generate radiant energy RE, a reflective (upper) layer 120 configured to reflect solar radiation. Emitter layer 110 and reflective layer 120 are preferably in direct contact with each other to promote the transmission of radiant energy RE from emitter layer 110 to reflector layer 120, but may be separated by an optional intervening layer 130 (e.g., a layer of adhesive or selective filter material). In a practical setting, panel 100 is oriented in a horizontal plane such that a bottom surface 111 of emitter layer 110 faces the ground (i.e., faces downward), and upper surface 122 of reflective layer 120 faces the sky (i.e. upward). The total cooling power of panel 100 is proportional to its horizontal size (i.e., panel length $L_P$ times panel width $W_P$), and is thus determined by practical considerations (i.e., the total cooling power required for a given application, practical process limitations, etc.). In an exemplary embodiment, a nominal size of panel 100 is 1 $m^2$. The total thickness $T_P$ of panel 100 (which is not drawn to scale in the figures) is determined by practical manufacturing considerations, but in general is made as small as possible to minimize material costs and panel weight, and may be in the range of 1 mm to 10 mm in the practical embodiments mentioned below.

FIG. 2 shows panel 100 during daylight operation (i.e., while incident solar radiation ISR is directed by the sun onto upper surface 122). Referring the lower portion of FIG. 2, emitter layer 110 includes a base material layer 113 having bottom surface 111 and an opposing top surface 112 that faces a lower (downward-facing) surface 121 of reflective layer 120. Note that emitter layer 110 is illustrated as separated from reflective layer 120 for descriptive purposes, and that top surface 112 typically contacts lower surface 121.

According to an aspect of the present invention, emitter layer 110 is implemented using a metamaterials-enhanced material including metamaterial nanostructures 118 (i.e., subwavelength engineered structures with tailored optical properties) disposed in or otherwise formed on a suitable base material 113 and configured to dissipate heat by way of emitting radiant energy RE that is transmitted from top surface 112 (i.e., upward toward reflective layer 112). According to another aspect of the invention, emitter layer 110 is configured such that at least some of emitted radiant energy RE, referred to here is portion RE-ATW, is generated at frequencies/wavelengths corresponding to one or more atmospheric transparency windows. That is, atmospheric transparency window (ATW) radiant energy portion RE-ATW only includes radiant energy having wavelengths that fall within known atmospheric transparency windows, such as in the range of 8 μm to 13 μm (corresponding to the primary ATW, and/or in the range of 16 μm to 28 μm). Radiant energy RE is emitted from top surface 112 of emitter layer 110 such that at least portion RE-ATW passes through reflective layer 120 and is transmitted from upper surface 122 through the lower atmosphere from the Earth's surface into cold near-space CNS. That is, because radiant energy portion RE-ATW has frequencies associated with one or more atmospheric transparency windows, it passes directly through Earth's atmosphere and into space without absorption and re-emission, and thus without heating the atmosphere above panel 100. Thus, panel 100 achieves a net cooling effect when radiant energy portion RE-ATW dissipates thermal energy TE from panel 100 faster than it is received (e.g., by way of incident solar radiation ISR).

In a presently preferred embodiment, emitter layer 110 is fabricated such that metamaterial nanostructures 118 are disposed in an ultra-black metamaterial-based pattern on base material layer 113, thereby forming an ultra-black material that functions to convert thermal energy TE into radiant energy RE. In some embodiments, metamaterial nanostructures 118 include nanopores, or other needle-like, dendritic or porous textured surfaces, carbon nanotube forests, or other black films (e.g. black chrome, black silicon, black copper, nickel phosphorus (NiP) alloys). In the presently preferred embodiments, any such ultra-black materials are fabricated such that the size, shape and spacing of metamaterial nanostructures 118 produce optical characteristics that generate radiant energy portion RE-ATW with an emissivity close to unity (i.e., the ultra-black material of emitter 110 generates radiant energy portion RE-ATW with an emissivity of 0.998 or greater).

Figure 3:
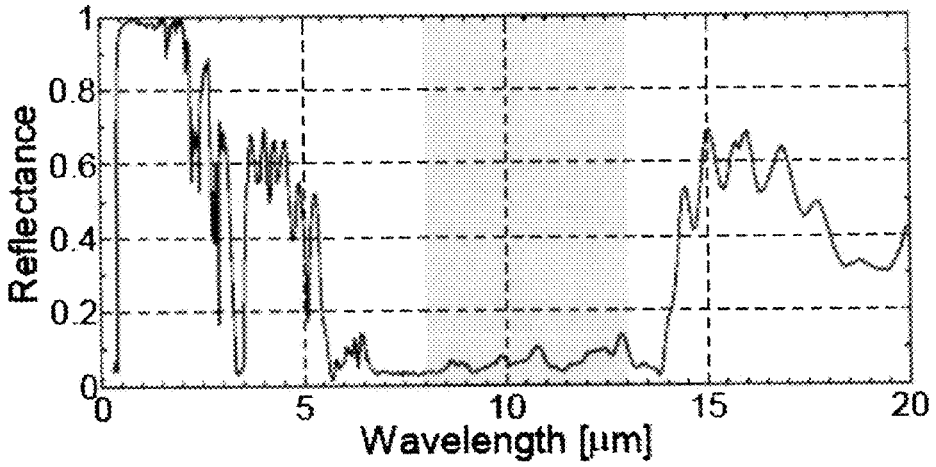
FIG. 3 is a diagram depicting optical properties of the upper reflective layer utilized in the passive radiative cooling panel of FIG. 2.

Referring again to FIG. 2, reflective layer 120 functions to shield emitter layer 110 from solar radiation by reflecting incident solar radiation ISR directed onto upward-facing surface 122 while simultaneously transmitting therethrough (i.e., passing from downward-facing surface 121 to upward-facing surface 122) at least radiant energy portion RE-ATW, which is emitted upward from emitter layer 110. In one embodiment, reflective layer 120 is configured to reflect at least 94% of incident solar radiation ISR. In a preferred embodiment, reflective layer 120 comprises a distributed Bragg reflector including multiple sublayers 125 collectively configured to reflect incident solar radiation and to transmit therethrough ATW radiant energy with characteristics similar to those depicted in the graph shown in FIG. 3. That is, in the preferred embodiment, reflective layer 120 exhibits reflectance of incident solar radiation ISR having wavelengths in the range of 0 to 2 μm with a reflectance value of 0.8 or greater, and effectively transmits/passes therethrough ATW energy portion RE-ATW (i.e., exhibit a reflectance of 0.2 or lower for radiant energy at least in the primary ATW of 8-13 μm). In some embodiments, commercially available solar mirror films currently used in concentrating solar power (CSP) collectors (e.g., solar films produced by 3M Corporation of St. Paul, Minn. USA, or by ReflecTech, Inc. of Arvada, Colo. USA) exhibit spectral characteristics that are close enough to the desired spectrum, and may be cost-effectively secured to the top surface 112 of the emitter layer 110, e.g., by way of an optional intervening adhesive layer. In other embodiments that require a reflective layer that selectively transmits only ATW radiant energy, custom engineered reflective layers may be required.

Referring again to FIG. 2, exemplary radiant energy RE emitted from panel 100 includes both radiant energy portion RE-ATW and other (non-ATW) portions (i.e., radiant energy having frequencies outside of the ATW windows). Although passive radiative cooling panels 100A formed in accordance with the present invention may emit, in addition to the ATW radiant energy portion, some non-ATW radiant energy (i.e., radiant energy having frequencies outside of the ATW windows), in the preferred embodiment substantially all non-ATW radiant energy is precluded.

Figure 2A:
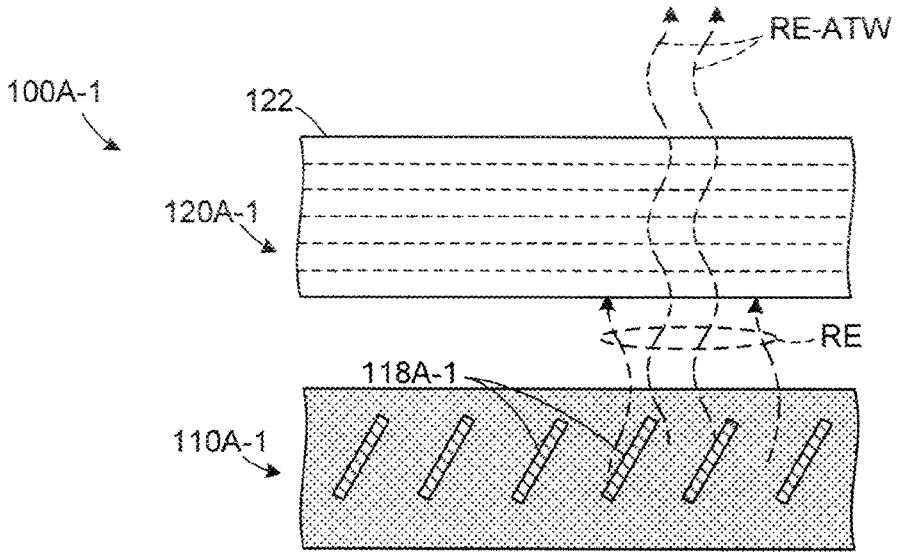
FIGS. 2A and 2B are cross-sectional side views showing alternative versions of the passive radiative cooling panel of FIG. 2 during operation.
Figure 2B:
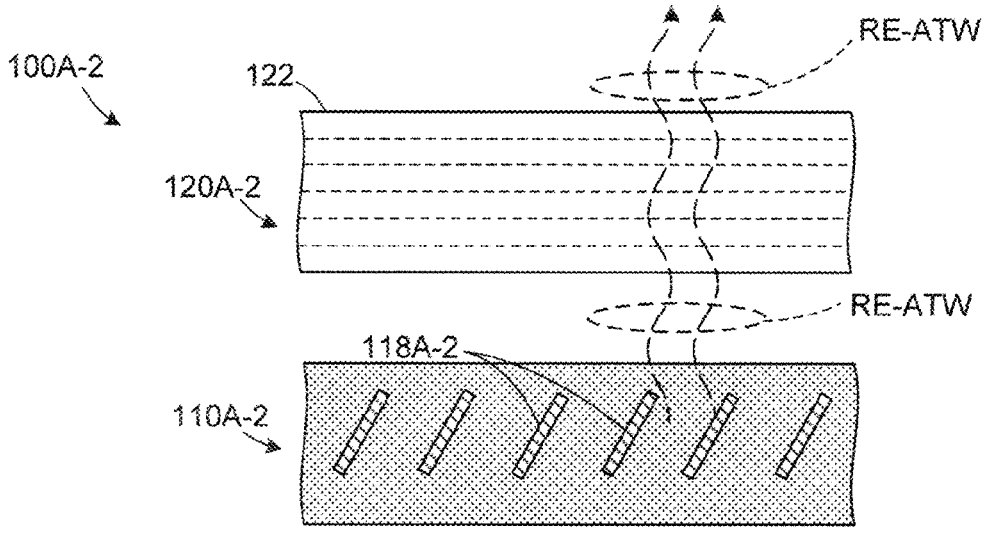

FIGS. 2A and 2B respectively depict panels 100A-1 and 100A-2 implementing two alternative embodiments in which only radiant energy RE-ATW (i.e., all radiant energy emitted from upper surface 122 has wavelengths/frequencies that are within an ATW window). In FIG. 2A, panel 100A-1 includes an emitter layer 110A-1 implemented using a low-cost ultra-black material in which metamaterial nanostructures 118A-1 are configured to emits broadband radiant energy (i.e., having frequencies both within and outside the atmospheric transparency windows), and upper reflective layer 120A-1 is configured to selectively transmit only radiant energy portion RE-ATW (e.g., portions of the broadband radiant energy having wavelengths in the range of 8-13 μm and/or in the range of 16-28 μm), and configured to block all non-ATW radiant energy (e.g., having wavelengths below 7 μm, in the range of 14 μm to 15 μm, or above 17 μm). In FIG. 2B, panel 110A-2 includes an emitter layer 110A-2 comprises a custom fabricated ultra-black material in which metamaterial nanostructures 118A-2 are configured to only generate radiant energy having wavelengths associated with one or more atmospheric transparency windows, whereby reflective layer 120A-2 may be implemented by a reflective material having lower selective transmission tolerances than that required by reflective layer 120A-1.

Figure 4:
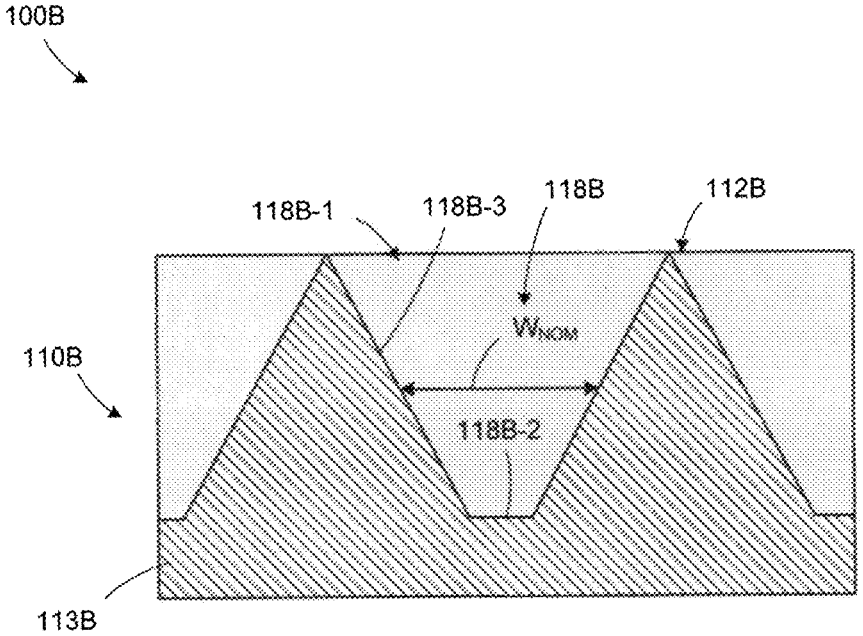
FIG. 4 is a cross-sectional side view showing a simplified ultra-black material including tapered nanopore-type metamaterial nanostructures according to another embodiment of the present invention.

FIG. 4 is a partial cross-sectional side view showing a panel 100B according to an embodiment of the present invention in which emitter layer 110B is an ultra-black material including an array of tapered nanopores (metamaterial nanostructures) 118B that are defined into a base material 113B, where each tapered nanopore 118B is a pit-like cavity having an open upper end 118B-1 defined through the top emitter surface 112B, a closed lower end 118B-2 disposed inside the base material 113B, and a substantially conical-shaped side wall 118B-3 extending between the open upper end 118B-1 and the closed lower end 118B-2. In this embodiment, open upper end 118B-1 has a larger diameter than closed lower end 118B-2 such that a diameter of the conic side wall 118B-3 decreases inside each tapered nanopore (i.e., decreases in proportion to a distance from top surface 112B). The use of tapered nanopores 118B having a suitable size (e.g., having a nominal width $W_{NOM}$ in the range of 100 nm to 1 μm) facilitates the production of superior ultra-black materials capable of emitting radiant energy having wavelengths in at least one of the atmospheric transparency window wavelength ranges of 8 μm to 13 μm and 16 μm to 28 μm with high emissivity because the tapered structures effectively have smoothly varying refractive indices (grated index medium) that prevent Fresnel reflections.

Figure 5:
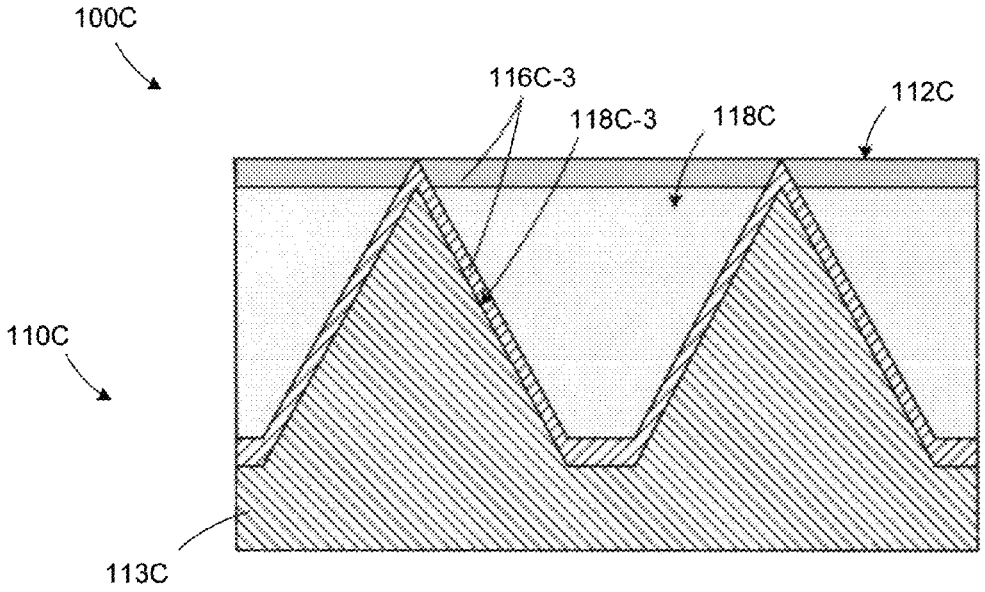
FIG. 5 is a cross-sectional side view showing a simplified ultra-black material including metal-plated tapered nanopores according to another embodiment of the present invention.

FIG. 5 is a partial cross-sectional side view showing a panel 100C according to an embodiment of the present invention in which emitter layer 110C is an ultra-black material including an array of metal-plated tapered nanopores 118C. In this embodiment, emitter layer 110C includes a base material layer 113C and a plated metal layer 116C disposed on the upper surface of base material layer 113C such that plated metal layer 116C is formed on tapered side walls 118C-3 (i.e., inside each metal-plated tapered nanopore 118C). Plated metal layer 116C typically comprises a different metal than that forming base material layer 113C. In addition to impedance matching, plated metal layer 116C enhances the performance of metal-coated tapered nanopores 118C in that the plated metal serves to scatter light inside the ultra-black material, which significantly contributes to the emission of ATW radiant energy. In addition, the large imaginary part of the refractive index of plated metal layer 116C contributes to the attenuation of the light inside tapered nanopores 118C, producing low reflectance from top surface 112C that will physically result in an extremely dark appearance. In an exemplary embodiment, the base metal layer 113C is implemented using aluminum, and the plated (second) metal layer 116C comprises one or more of nickel (Ni) copper (Cu) and gold (Ag).

Figure 6:
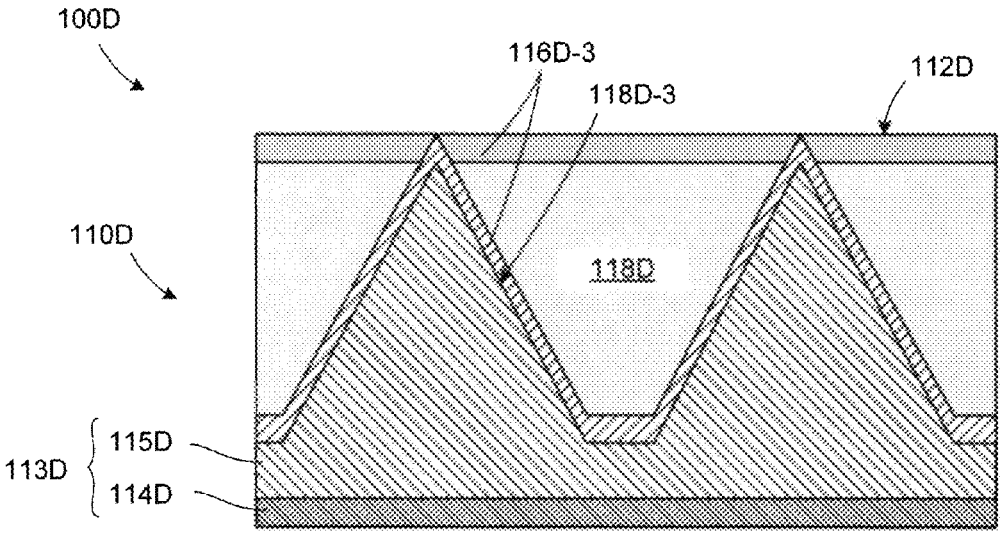
FIG. 6 is a cross-sectional side view showing a ultra-black material including metal-plated tapered nanopores formed using a modified AAO self-assembly technique according to a practical embodiment of the present invention.
Figure 7:
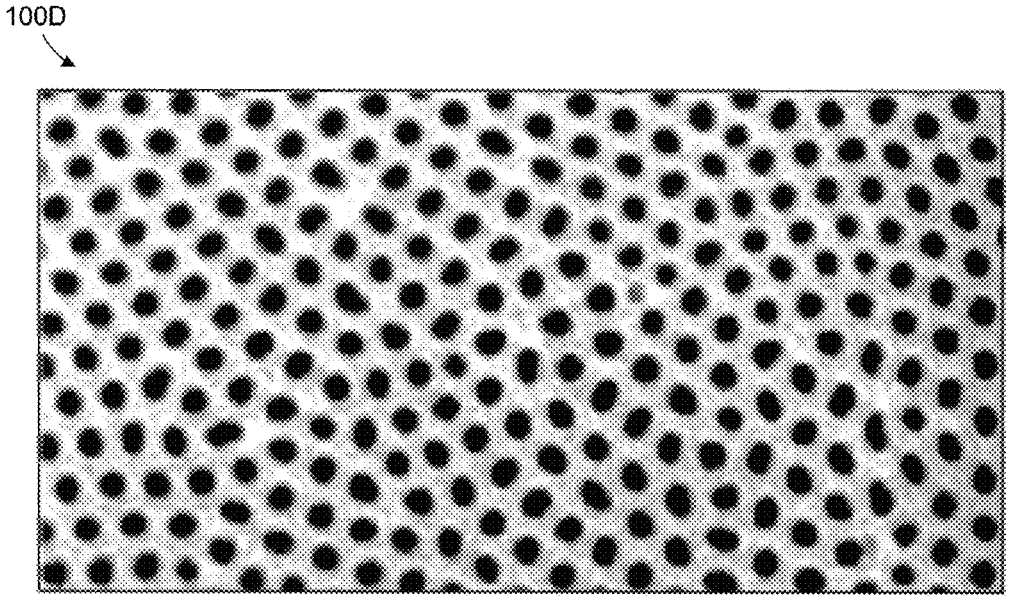
FIG. 7 is a diagram depicting exemplary optical properties of an emitter layer utilized in the emitter layer of FIG. 6.
Figure 8:
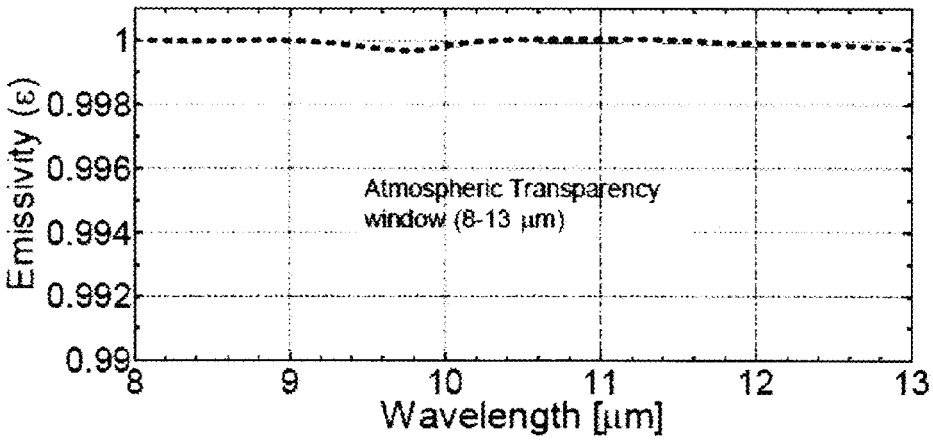
FIG. 8 is a top plan view depicting an exemplary array of nanopores arranged in a hexagonal pattern.

FIG. 6 is a partial cross-sectional side view showing an emitter layer 110D of a panel 100D according to another embodiment of the present invention in which metal-plated tapered nanopores 118D are formed on a base material layer 113D including an aluminum layer 114D and an aluminum oxide layer 115D disposed on the aluminum layer 114D, wherein tapered nanopores 118D are entirely defined within aluminum oxide layer 115D. Emitter layer 110D is fabricated using a modified Anodic Aluminum Oxide (AAO) self-assembly template technique in which aluminum layer 114D is anodized in acid to form porous alumina (aluminum oxide) layer 115D thereon such that the alumina layer 115D includes self-formed, hexagonally packed arrays of tapered nanopores similar to the arrangement shown in FIG. 7. By gradually changing the process parameters during anodization, tapered nanopores 118D are thus fabricated entirely during the alumina formation process. The pitch and diameter (nominal width $W_{NOM}$) of each tapered nanopore 118D formed by this method are dependent on the anodization voltages and process conditions, while the height of each nanopore is controlled by the anodization time. This AAO method is a high-throughput, bottom-up, and low-cost fabrication method to fabricate subwavelength (e.g., sub-50 nm) and very high-aspect ratio (1:1000) tapered nanopores. Because passive radiative cooling inherently requires a large area (i.e., square kilometers) of panels when it comes to practical applications, such as power plant dry cooling, a main techno-economic challenge for developing a passive radiative cooling panel rests on the ability to cost-effectively mass-produce the panels. By forming emitter layer 110D with tapered nanopores 118D using the AAO self-assembly template technique, and then electroless plating a second metal 116D (e.g., Ni, Cu or Ag) onto alumina layer 115D in the manner described above, superior metal-coated tapered nanopores are produced with high efficiency, and in a manner that facilitates low-cost mass production of passive radiative cooling panels 100D using cost-effective roll-to-roll mass-production manufacturing techniques. The dashed line in FIG. 8, which indicates emissivity values generated using finite element method (FEM) simulations, shows that emitter layer 110D exhibits an emissivity close to unity in the atmospheric transparency window of 8 μm to 13 μm. Additional details regarding the production of panel 100D are provided in co-owned and co-pending U.S. patent application Ser. No. 14/740,032, entitled PRODUCING PASSIVE RADIATIVE COOLING PANELS AND MODULES, which is incorporated by reference herein in its entirety.

Figure 9:
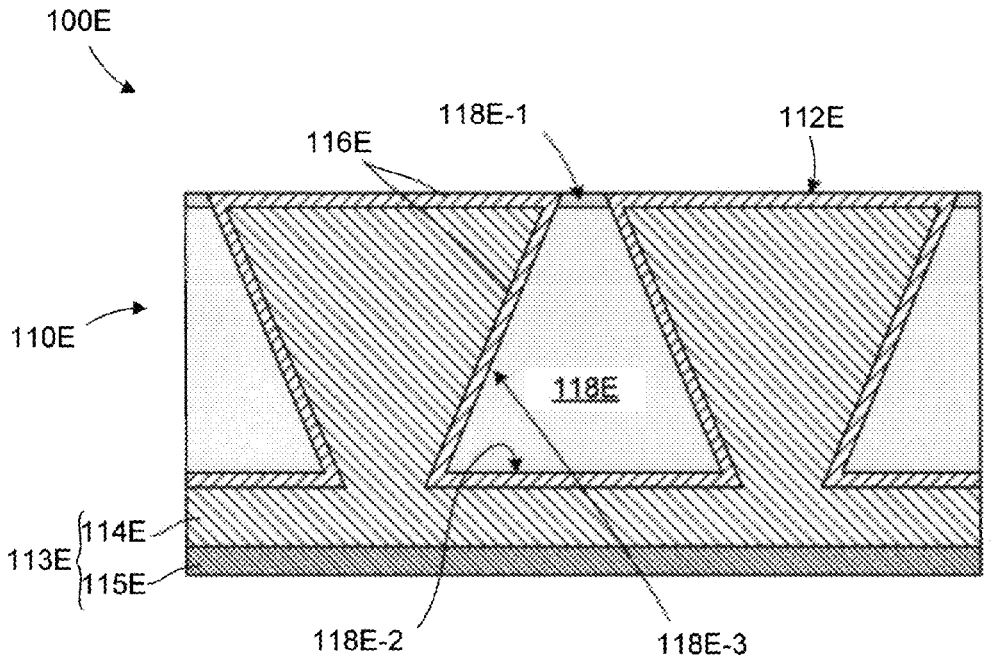
FIG. 9 is a cross-sectional side view showing a ultra-black material including inverted tapered nanopores according to an alternative embodiment of the present invention.

Although the present invention has been described with respect to certain specific embodiments, it will be clear to those skilled in the art that the inventive features of the present invention are applicable to other embodiments as well, all of which are intended to fall within the scope of the present invention. For example, although the invention is described with specific reference to tapered nanopores, suitable emitter layer may include an ultra-black material utilizing another type of metamaterial nanostructures, such as nanowires. Further, other nanopore configurations may be used in place of the decreasing tapered nanopore described above. For example, FIG. 9 is a cross-sectional side view showing an emitter layer 110E of a passive radiative cooling panel 100E formed in accordance with another embodiment in which the taper direction of each tapered nanopore 118E is opposite to the decreasing taper of the embodiments described above. Specifically, an open upper end 118E-1 of each reverse-tapered nanopore 118E is smaller than its closed lower end 118E-2, whereby a diameter of conic side wall 118E-3 gradually increases inside each tapered nanopore 118E. Reverse-tapered nanopores 118E are believed to be producible using a modified version of the AAO self-assembly process mentioned above (i.e., with base material layer 113E including an aluminum lower layer 114D and an upper aluminum oxide layer 115D), and also supports the metal plating process mentioned above (i.e., such that plated metal layer 116E is formed on upper surface 112E and inside each reverse-tapered nanopore 118E). Reverse-tapered nanopores 118E are believed to be producible are also believed to potentially provide superior ultra-black optical properties.

The invention claimed is:

1. A passive radiative cooling panel comprising:

an emitter layer including a plurality of metamaterial nanostructures configured to dissipate heat by generating radiant energy that is emitted from a surface of the emitter layer, wherein the metamaterial nanostructures are further configured such that at least a portion of said generated radiant energy having wavelengths corresponding to one or more atmospheric transparency windows is emitted with an emissivity of at least 0.998;

an upper layer having a downward-facing surface facing the surface of the emitter layer and an opposing upward-facing surface, wherein the upper layer is configured to reflect incident solar radiation directed onto the upward-facing surface, and configured to transmit at least said portion of said radiant energy emitted from the emitter layer, whereby said portion of said radiant energy is transmitted through the upward-facing surface of the upper layer; and wherein the emitter layer comprises a base material layer including an array of said metamaterial nanostructures, the array of metamaterial nanostructures comprises an array of tapered nanopores defined into the base material layer, a nominal width of each said tapered nanopore is equal to or less than 1 micron.

2. The passive radiative cooling panel according to claim 1, wherein the emitter layer comprises the base material layer including the array of said metamaterial nanostructures arranged in an ultra-black metamaterial-based pattern that is configured to generate said portion of said radiant energy with wavelengths corresponding to said one or more atmospheric transparency windows.

3. The passive radiative cooling panel according to claim 2, wherein the ultra-black metamaterial-based pattern is further configured to generate said portion of said radiant energy with wavelengths in the ranges including 8 μm to 13 μm and 16 μm to 28 μm.

4. The passive radiative cooling panel according to claim 2, wherein the ultra-black material is configured to generate broadband radiant energy including both said portion of said radiant energy with wavelengths corresponding to said one or more atmospheric transparency windows, and also a non-atmospheric transparency windows (non-ATW) portion having wavelengths outside of said one or more atmospheric transparency windows, and wherein said upper layer is configured to block said non-ATW portion such that only said portion of said radiant energy is transmitted through the upward-facing surface of the upper layer.

5. The passive radiative cooling panel according to claim 2, wherein the ultra-black material is configured to only generate radiant energy with wavelengths corresponding to said one or more atmospheric transparency windows.

6. A passive radiative cooling panel comprising:

an emitter layer including an ultra-black material that is configured to convert thermal energy into radiant energy such that at least a portion of said radiant energy has wavelengths in the range of 8ym to said radiant energy is generated with an emissivity of at least 0.998;

an upper layer disposed to receive said radiant energy on a lower surface thereof, said upper layer being configured to reflect incident solar radiation directed onto an upper surface thereof, said upper layer further configured to pass therethrough said portion of said radiant energy having wavelengths in the range of 8 μm to 13 μm such that said emitted radiant energy portion is transmitted from said upper surface; and wherein ultra-black material comprises an array of tapered nanopores defined into a base material layer, a nominal width of each said tapered nanopore is equal to or less than 1 micron.

* * * * *